US005087139A

United States Patent [19]

Pinoteau et al.

[11] Patent Number: 5,087,139

[45] Date of Patent: Feb. 11, 1992

[54] DEVICE FOR APPLYING MAKE-UP, INCORPORATING REPLACEABLE RESERVOIR

[75] Inventors: Maurice Pinoteau, Maisons Alfort; Bernard Mallet, Le Chesnay, both of France

[73] Assignee: Parfums Christian Dior, Paris, France

[21] Appl. No.: 297,857

[22] PCT Filed: Jun. 19, 1987

[86] PCT No.: PCT/FR87/00234

§ 371 Date: Dec. 6, 1988

§ 102(e) Date: Dec. 6, 1988

[87] PCT Pub. No.: WO87/07821

PCT Pub. Date: Dec. 30, 1987

[30] Foreign Application Priority Data

Jun. 20, 1986 [FR] France ..... 86 08968

[51] Int. Cl.[5] ..... A45D 33/02

[52] U.S. Cl. ..... 401/206; 401/205; 401/288; 401/268

[58] Field of Search ..... 401/277, 278, 275, 286, 401/279, 273, 268, 270, 272, 288, 205, 206

[56] References Cited

U.S. PATENT DOCUMENTS

| | | | |
|---|---|---|---|
| 1,425,242 | 8/1922 | Dinardo | 401/278 |
| 2,331,672 | 10/1943 | Falkman . | |
| 3,589,824 | 6/1971 | Andrews | 401/273 |
| 3,682,559 | 8/1972 | Hirota | 401/205 |
| 4,906,120 | 3/1990 | Sekiguchi | 401/279 |
| 4,940,351 | 7/1990 | Konose | 401/273 |

FOREIGN PATENT DOCUMENTS

| | | |
|---|---|---|
| 2036855 | 3/1972 | Fed. Rep. of Germany . |
| 3006463 | 9/1981 | Fed. Rep. of Germany . |
| 2551636 | 3/1985 | France . |
| 248643 | 2/1948 | Switzerland . |

*Primary Examiner*—Robert A. Hafer
*Assistant Examiner*—Sam Rimell
*Attorney, Agent, or Firm*—Bryan, Cave, McPheeters & McRoberts

[57] ABSTRACT

A device for applying a powdery material, suitably make-up, comprising a casing (4) containing a powdery material reservoir (6) mounted displaceably with respect to the casing (4) and dismountably integral with an intermediate part (22) which is integral with an obturation element (16) forming valve (18). The obturation element (16) comprises a stem (17) of a length sufficient to have its free end (17*a*) accessible from outside the device when the reservoir (6) is dismounted. An easy-to-clean refillable device is thus provided, which facilitates changing the shade of the powder applied during use.

12 Claims, 1 Drawing Sheet

DEVICE FOR APPLYING MAKE-UP, INCORPORATING REPLACEABLE RESERVOIR

The present invention essentially relates to a device applying a powdery material comprising a reservoir forming pusher, refillable and easy to clean, usable in particular for making-up.

Various devices for applying a powdery material, particularly pigmented powder for make-up, are already known.

For example, DE-A1-3 006 463 describes a device for applying a powdery material comprising an element forming case 1, comprising a part forming reservoir defining a reserve of powdery material. The element forming case is provided at one end with a closure element 16 supporting a tuft 22 or bundle of hairs or filaments F. The reservoir comprises an opening 17 for at least temporary communication between the cavity and said tuft F, usually obturated by an obturation element 18 forming valve opened or closed with the aid of a member forming pusher 8, 9 fast with said obturation element, mounted to be displaceable with respect to the case 1 and accessible to the user.

Such a known device is made in integral manner, non-dismountable so as to form a disposable unit which is not refillable.

Now, the need is felt more and more to make devices of refillable nature so as to reduce the manufacturing costs and concomitantly the cost price of such a device for the user.

This device does not allow a regular distribution in the tuft, which necessitates shaking the device and risks causing detrimental projections.

In addition, another drawback of this known type of device resides in the fact that it is not possible to use the same applicator device for different shades of powdery material, whereas the customer is seeking more and more the possibility of changing shade during use without having to purchase new complete applicator devices, in particular by reason of their price.

In addition, in order to allow a change of shade during use, or for cleaning in order to reduce smudges due to contact with the skin, the device must be able to be easily and completely cleaned. The distribution of the material must also be regularly dosed.

It is a principal object of the present invention to solve the new technical problem consisting in an essentially uniform distribution of the powdery material in the hairs or filaments constituting the tuft and in the delivery of a relatively regular dose of powdery material, whilst avoiding any clogging.

It is also a principal aim of the present invention to solve the technical problem consisting in providing a device for applying a powdery material of refillable nature.

It is yet another principal aim of the present invention to solve the technical problem constituted by providing a device applying a powdery material which is easy to clean so as to allow a change of shade during use by the insertion of a new refill containing a powdery material of different shade.

All these technical problems are simultaneously solved for the first time by the present invention, in completely unexpected and non-obvious manner.

The present invention therefore provides a device for applying a powdery material, in particular pigmented powder for making-up, comprising an element forming case, for example of substantially cylindrical form, comprising a part forming reservoir defining a reserve cavity of powdery material, said element forming case being provided at one end with a closure element supporting a tuft or bundle of hairs or filaments, said reservoir comprising an opening for at least temporary communication between said cavity and said tuft, usually obturated by an obturation element forming valve opened or closed with the aid of a member forming pusher fast with said obturation element, mounted displaceable with respect to the case and accessible to the user, characterized in that said member forming pusher is formed by said reservoir which is mounted displaceable relatively to said case, presenting a part accessible from the outside, being in projection relatively to the case.

In a preferred embodiment, the reservoir is dismountably connected to an intermediate piece mounted displaceably inside the case and with which the element forming valve is connected.

According to a particular embodiment, the element forming valve comprises a rod fast with said intermediate piece, of which one end comprises said valve proper, said rod being provided to be of a sufficient length to have its free end opposite that comprising said valve accessible from the outside when the reservoir is dismounted.

According to an advantageous feature of the invention, the said rod comprises mechanical stirring means on its periphery over at least a part of its length. These mechanical stirring means preferably comprise radially projecting shoulders, advantageously formed by a thread, thus obtaining a mechanical effect of mixing of the powdery material.

According to a particular embodiment, the intermediate piece is located in the case at a certain distance from the obturation element, thus defining an intermediate chamber for distribution of the powdery material. This intermediate piece is advantageously pushed in the direction opposite the obturation element by an elastic return means.

According to a particular embodiment of the device according to the invention, the said case is made of at least two parts connectable together, bulging or convex outwardly with parting line passing through said bulging or convex parts, said reservoir also presenting a corresponding bulging or convex part so that one of the bulging parts serves as means for locking the reservoir in place.

According to a variant embodiment, the reservoir may simply be clipped or fitted on the intermediate part.

According to another variant embodiment, the obturation element may be made in one piece with the first bulging piece. Likewise, the obturation element may present the form of a funnel and be made to be dismountable relatively to the case.

It will thus be understood that, upon application of a thrust on the reservoir, an effect of blast will be produced therein and, as the case may be, in the intermediate distribution chamber, this making it possible to stir the powdery material, avoiding blockages and a better distribution thereof, rendering possible a substantially uniform distribution of powdery material in the hairs, the delivery of a relatively regular dose of powdery material, avoiding the presence of an excess of powdery material in the tuft of hair and of smears of the various objects by loss and/or projection.

Any clogging is also thus avoided.

Furthermore, by the dismountable nature of the reservoir, this device presents a refillable character, which makes it possible to reduce the manufacturing costs and price thereof.

In addition, by the fact that the element forming valve comprises a rod which is accessible from the outside when the reservoir is dismounted, this device may be easily cleaned in its entirety, this allowing a change of shade during use, without any limitation.

Finally, by providing stirring means on the rod, a mechanical effect of mixing is further obtained, further avoiding any clogging.

The invention therefore brings multiple technical advantages, which are unexpected and non-obvious for a man skilled in the art.

The preferred use of the device for applying powdery material according to the invention concerns the application of pigmented powder for making-up, therefore in the cosmetic field. On this subject, the making-up of the cheeks, the eye-lids may be mentioned, but other applications may of course be envisaged without departing from the scope of the invention.

The invention will now be described in greater detail with reference to the accompanying drawings showing two presently preferred embodiments of the invention, given simply by way of illustration and which could therefore in no way limit the scope of the invention.

Figure 1:
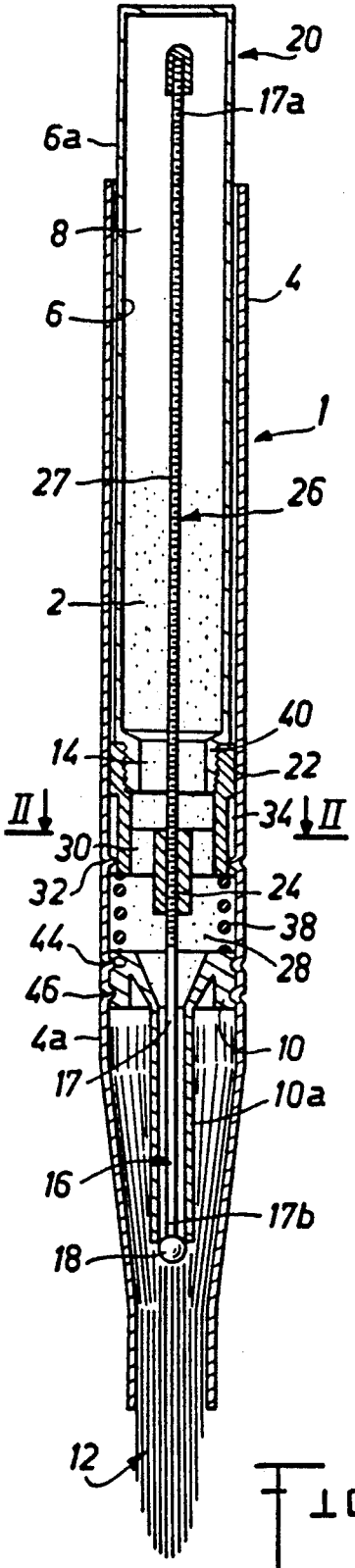
FIG. 1 shows a first embodiment of a device according to the invention for applying a powdery material, in axial longitudinal section, more particularly adapted to the making-up of the eye-lids.
Figure 2:
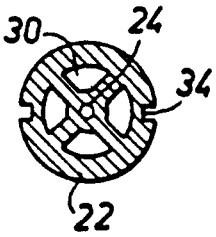
FIG. 2 is a view in section along line II—II of FIG. 1.

Referring to FIGS. 1 and 2, a device according to the invention, shown by general reference number 1, for applying a powdery material 2, in particular pigmented powder for making-up, comprises an element forming case 4, comprising a part forming reservoir 6 defining a reserve cavity 8 for powdery material 2. The case 4 may be of substantially cylindrical shape, as shown, or of any shape.

This element forming case 4 is provided at one end 4*a* with a closure element 10 supporting a tuft 12 or bundle of hairs or filaments. The reservoir 6 comprises an opening 14 for at least temporary communication between the cavity 8 and the tuft 12, usually obturated by an obturation element 16 forming valve 18 opened or closed with the aid of a member forming pusher 20 fast with the obturation element 16, mounted displaceable relatively to the case and accessible to the user.

According to the present invention, this device is characterized in that the member forming pusher 20 is formed by the reservoir 6 which is mounted displaceable relatively to the case 4, advantageously presenting a part 6*a* projecting relatively to the case 4, accessible from the outside, as clearly visible in FIG. 1.

Naturally, the reservoir 6 is mounted to be displaceable between a position of rest for which the valve 18 is closed and a position of opening where the valve releases the opening and thus allows a distribution of a dose of powdery material.

According to a preferred embodiment, the reservoir 6 is dismountably connected to an intermediate piece 22 mounted to be displaceable inside the case 4 and to which is connected the element forming valve 16, as is clearly visible in FIG. 1.

It will be observed that the element forming valve 16 comprises a rod 17 fast with the intermediate piece, for example by being fixed thereto by threading in a corresponding orifice 24, axial in the present case. One end of the rod 17 comprises the valve 18 proper. This rod 17 length to have its free end 17*a*, opposite that 17*b* comprising the valve 18, accessible from the outside when the reservoir is dismounted, advantageously by being disposed in projection relatively to the case 4, as shown.

According to an advantageous characteristic of the invention, the rod 17 comprises mechanical stirring means 26 on its periphery, over at least a part of its length, preferably in that part of the rod located inside the reservoir 6, These stirring means advantageously comprise radially projecting shoulders which, for simplicity of manufacture, may be constituted by a thread 27.

A mechanical effect of mixing of the powdery material contained in the reservoir 6 is thus obtained.

According to a preferred characteristic of the invention, the intermediate piece 22 is located in the case 4 at a certain distance from the element 10 for closing the case 4, thus defining an intermediate chamber 28 for distribution of the powdery material.

It will be observed, as mentioned previously, that the displacement of the reservoir 6 produces an effect of blast effecting a stirring of the powdery material, by the reduction of the volume occupied in particular by the intermediate chamber 28. This procures the technical advantages set forth hereinabove.

Naturally, the intermediate piece 22 comprises through orifices 30 which are clearly seen in FIG. 2, so as to communicate the cavity 8 with the intermediate chamber 28 and the closure element 10 cooperating with the element forming valve 16. It will be observed that the intermediate piece 22 is provided with an anti-rotation device by providing a radially internal shoulder system 32 cooperating with grooves 34 made in the intermediate piece, also serving as stop of penetration of the intermediate piece. In addition, the intermediate piece 22 is pushed in the direction opposite valve 18 by an elastic return means 38.

The reservoir 6 is here mounted to be dismountable relatively to the intermediate piece by being connected thereto by corresponding threaded parts 40.

According to this embodiment, the closure element 10 is also mounted in dismountable manner inside the case 4 by comprising grooves 44 cooperating with internal bosses 46, as is conventional.

Advantageously, the closure element 10 presents the form of a funnel comprising a relatively large cylindrical part terminating in a median zone of the tuft of hairs 12, so as to distribute the powdery material towards the centre of this tuft.

Operation of this device is clearly apparent to the man skilled in the art and results from the preceding description. It will be understood that, upon a thrust on the reservoir 6, the valve 18 which is fast with the intermediate piece 22 to which the reservoir itself is connected, will be opened.

Such thrust will give an effect of blast inside the reservoir 6, effecting a stirring of the powdery material, whilst ending in a distribution of a dose of powder by the valve 18, this dose being distributed uniformly and regularly in the tuft 12.

When the thrust is released, the distribution of the dose is naturally stopped, whilst effecting a further effect of blast in the opposite direction.

If it is desired to change the reservoir to place a new refill or to change shade, it suffices to unscrew the reservoir 6. At that moment, the free end 17*a* of the rod 17 is accessible from the outside and the user may then apply a thrust thereon to open the valve 18 and allow complete cleaning of the device.

All the technical advantages set forth hereinabove are therefore obtained.

Figure 3:
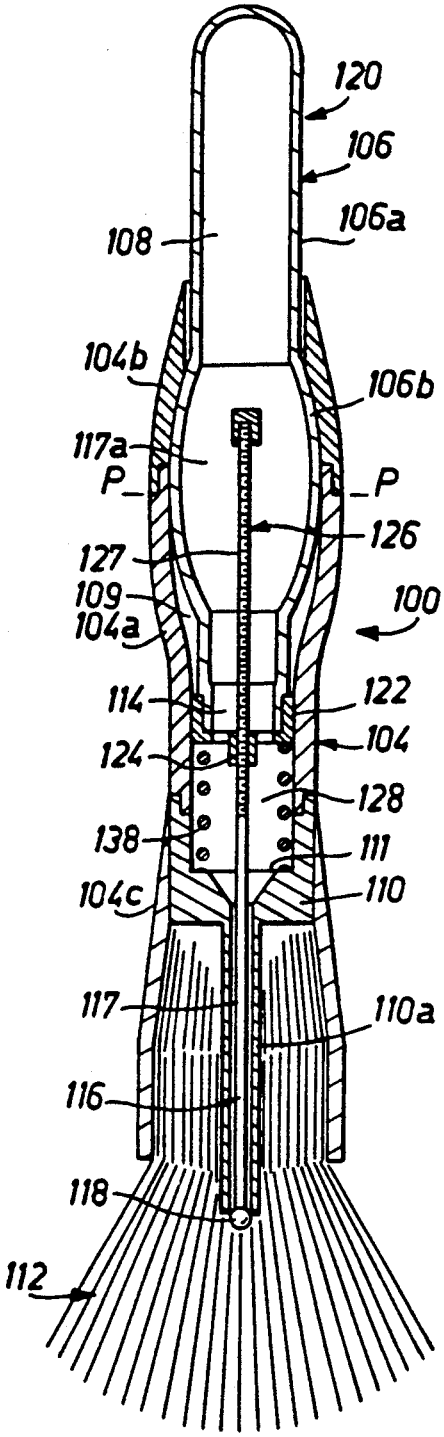
FIG. 3 is a view in axial longitudinal section of a second embodiment of an applicator device according to the invention, more particularly adapted for making-up the face.

With reference to FIG. 3, according to a second embodiment of the invention, the applicator device 100 comprises a case 104 made at least of two parts 104*a*, 104*b*, connected together with parting line P passing through said bulging or convex part, as clearly visible in FIG. 3.

This device also comprises a reservoir 106 having a corresponding bulging or convex part 106*b* so that one 104*b* of the bulging parts serves as means for locking the reservoir 106 in place, as is clearly understandable from FIG. 3, whilst arranging a space 109 for displacement of the reservoir 106.

It will be observed that parts 104*a*, 104*b* are connectable together, preferably by simple screwing, fitting or clipping, or the like.

Similarly, the reservoir 106 is preferably also clipped or fitted on the intermediate piece 122 mounted to be displaceable inside the case 104.

Furthermore, according to this second embodiment, it may be provided that the closure element 110 of the case presents, opposite the intermediate piece 122, a U-section so as to constitute a part of the intermediate chamber 128, being located in line with part 104*a* of the reservoir. Advantageously, it may be provided that part 104*a* is connected by screwing, fitting or clipping on the closure element 110, as shown. This closure element 110 may be made in one piece with the frontal part 104*c* of the case 104 or be locked thereon likewise by simple screwing, fitting or clipping.

It will be observed that all the pieces of this embodiment with functions similar to those of the embodiment of FIGS. 1 and 2, bear the same reference numbers increased by 100.

Thus, the obturation element bears reference number 116, the valve reference number 118, the tuft reference number 112, the stirring means reference number 126, the rod reference number 117, etc.

It will be observed that, in accordance with this embodiment, all the advantages of the preceding embodiment are obtained. In addition, it is ascertained that the obturation element 110 with its U-section, defines with part 104*a* of the case 104 a path for displacement or slide of the intermediate piece 122 connected with reservoir 106, whilst the base 111 of the U and the lateral edges of the U make it possible to maintain the return means 138 more in position. Finally, by the fact that the part 104*a* of the case 104 is also screwed, fitted or clipped on the frontal part 104*c* at the level of the closure element 110, an easy means of access to the central part of the device is obtained.

Naturally, this concept may also be made for the embodiment of FIGS. 1 and 2.

Furthermore, and as for the embodiment of FIGS. 1 and 2, the closure element 110 presents the form of a funnel presenting a tubular part 110*a* or 10*a*, of relatively large dimension. In practice, this makes it possible to define with high precision a dose of powdery material when the valve 118 or 18 is opened by action on the reservoir 106 or 6, respectively.

It will be understood that the invention therefore makes it possible to achieve, in unexpected and non-obvious manner, all the technical advantages set forth hereinabove.

We claim:

1. A device for applying a powdery material, comprising:

(a) a hollow care provided at one end with a closure element supporting a tuft or bundle of hairs of filaments;

(b) a dismountable and replaceable reservoir received in the case, defining a cavity for the powdery material and having an opening proximate to the closure element, said reservoir and said case having mutually cooperating dismounting means allowing said reservoir to be dismounted relative to said case;

(c) a valve for establishing at least temporary communication between the cavity and the tuft, the valve being defined by the closure element and comprising (i) an obturation element for opening and closing the valve, the obturation element being mounted within the closure element, extending into the cavity defined by the reservoir, and comprising a rod of sufficient length that its end remote from the valve protrudes relative to said case and is therefore accessible from outside the device when the reservoir is dismounted therefrom; and (d) the reservoir being of a length sufficient to define a protruding reservoir portion protruding relative to the case, said protruding reservoir portion constituting a pusher, said reservoir engaging the obturation element for longitudinally displacing said element relative to the case and thereby opening and closing the valve to dispense the powdery material at will.

2. The device of claim 1, further comprising an intermediate piece mounted for longitudinal displacement within said case between said cavity and said closure element, said piece being engaged and displaced by the pusher and, in turn, engaging the obturation element for longitudinally displacing said element through said case to open and close the valve.

3. The device of claim 2, wherein the intermediate piece is disposed between the opening in said reservoir and the closure element, and is so spaced from the closure element as to define an intermediate chamber for distributing the powdery material, the volume of the intermediate chamber being varied upon displacement of the intermediate piece.

4. The device of claim 1, wherein the rod comprising said obturation element has mechanical stirring means on its periphery over at least a part of its length extending into the cavity defined by the reservoir, for mixing the powdery material within said cavity.

5. A device for applying a powdery material, comprising:

(a) a hollow case provided at one end with a closure element supporting a tuft or bundle of hairs or filaments;

(b) a dismountable and replaceable reservoir received in the case, defining a cavity for the powdery material and having an opening proximate to the closure element, said reservoir and said case having mutually cooperating dismounting means allowing said reservoir to be dismounted relative to said case;

(c) a valve for establishing at least temporary communication between the cavity and the tuft, the valve being defined by the closure element and comprising (i) an obturation element for opening and closing the valve, the obturation element being mounted within the closure element, extending into the cavity defined by the reservoir, and comprising a rod of sufficient length that its end remote from the valve protrudes relative to said case and is therefore accessible from outside the device when the reservoir is dismounted therefrom, said rod having mechanical stirring means on its periphery over at least a part of its length and adapted to extend into said cavity for mixing the powdery material therein;

(d) the reservoir being of a length sufficient to define a protruding reservoir portion protruding relative to the case, said protruding reservoir portion constituting a pusher, said reservoir engaging the obturation element for longitudinally displacing said element relative to the case and thereby opening and closing the valve to dispense the powdery material at will; and (e) an intermediate piece displaceable mounted within the case for engagement with and displacement by the reservoir, said piece being in threaded engagement with the rod of the obturation element for holding the rod and longitudinally displacing it to simultaneously mix the powdery material in said cavity and open or close the valve to dispense the powdery material at will.

6. The device of claim 5, further including means preventing rotation of and limiting displacement of the intermediate piece within said case, and elastic return means normally biasing the intermediate piece toward the pusher and away from said closure element.

7. A device for applying a powdery material, comprising:

(a) a hollow case providing at one end with a closure element supporting a tuft or bundle of hairs or filaments, said case comprising at least two connectable, outwardly bulging parts, the parting line between said parts passing through the bulge therebetween;

(b) a dismountable and replaceable reservoir mounted in the case, the reservoir defining a cavity for the powdery material, having an opening proximate to said closure element and having a bulging part received in and being locked in place by at least one of the bulging parts of said case, said reservoir and said case having mutually cooperating dismounting means allowing said reservoir to be dismounted relative to said case;

(c) a valve for establishing at least temporary communication between the cavity and the tuft, the valve being defined by the closure element and comprising an obturation element mounted within the closure element for opening or closing the valve; and (d) the reservoir being of a length sufficient to define a protruding reservoir portion protruding relative to the case, said protruding reservoir portion constituting a pusher, said reservoir engaging the obturation element for longitudinally displacing said element relative to the case and thereby opening and closing the valve to dispense the powdery material at will.

8. The device of claim 7, wherein the obturation element extends into the cavity defined by the reservoir, and comprises a rod of sufficient length that its end remote from the valve is accessible from outside the device when the reservoir is dismounted therefrom.

9. A device for applying a powdery material, comprising:

(a) a hollow case provided at one end with a closure element supporting a tuft or bundle of hairs or filaments, the closure element having the shape of a funnel and having first and second openings therein, the first opening communicating with a central part of said tuft;

(b) a dismountable and replaceable reservoir received in the case and defining a cavity for the powdery material, the cavity having an opening communicating with the second opening of the funnel-shaped closure element, said reservoir and said case having mutually cooperating dismounting means allowing said reservoir to be dismounted relative to said case;

(c) a valve for establishing at least temporary communication between the cavity and the tuft, the valve being defined by the second opening in the closure element and comprising an obturation element mounted within the closure element for opening or closing said second opening; and (d) the reservoir being of a length sufficient to define a protruding reservoir portion protruding relative to the case, said protruding reservoir portion constituting a pusher, said reservoir engaging the obturation element for longitudinally displacing said element relative to the case and thereby opening and closing the valve to precisely dispense the powdery material within the tuft at will.

10. The device of claim 9, further comprising an intermediate piece mounted for longitudinal displacement within said case between said cavity and said closure element, the intermediate piece being so spaced from the second opening in the closure element as to define an intermediate chamber for distributing the powdery material, and the walls of the closure element adjacent said second opening defining a U-section defining guideways for longitudinal movement of the intermediate piece.

11. The device of claim 9, wherein the closure element is dismountably mounted on an intermediate part of the case.

12. The device of claim 9, wherein the case is made of at least two connectable, outwardly bulging parts, the parting line between said parts passing through the bulge therebetween, and said reservoir having a corresponding bulging part received in and locked in place by at least one of the bulging parts of said case.

* * * * *

UNITED STATES PATENT AND TRADEMARK OFFICE
CERTIFICATE OF CORRECTION

PATENT NO. : 5,087,139

DATED : February 11, 1992

INVENTOR(S): Maurice Pinoteau et al.

It is certified that error appears in the above-identified patent and that said Letters Patent is hereby corrected as shown below:

Column 4, line 8: After "This rod 17" insert --is provided according to the invention to be of a sufficient--.

Column 6, line 10: Claim 1, change "care" to --case--.

Column 6, line 11: Claim 1, change "hairs of" to --hairs or--.

Column 7, line 25: Claim 5, change "displaceable" to --displaceably--.

Signed and Sealed this

Twenty-second Day of June, 1993

*Attest:*

Michael K. Kirk

MICHAEL K. KIRK

*Attesting Officer*

*Acting Commissioner of Patents and Trademarks*